US005952874A

United States Patent [19]

Manaresi et al.

[11] Patent Number: 5,952,874

[45] **Date of Patent: *Sep. 14, 1999**

[54] THRESHOLD EXTRACTING METHOD AND CIRCUIT USING THE SAME

[75] Inventors: Nicoló Manaresi; Eleonora Franchi, both of Bologna; Dario Bruno, Palermo; Biagio Giacalone, Trapani, all of Italy

[73] Assignee: Consorzio per la Ricerca sulla Microeletrronica nel Mezzogiorno, Catania, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/574,491

[22] Filed: Dec. 19, 1995

[30] Foreign Application Priority Data

Dec. 30, 1994 [EP] European Pat. Off. ..... 94830593

[51] Int. Cl.[6] ..... G05F 1/10

[52] U.S. Cl. ..... 327/541; 327/543; 327/78

[58] Field of Search ..... 327/538, 539, 327/540, 541, 543, 545, 546, 77, 78

[56] References Cited

U.S. PATENT DOCUMENTS

| | | | |
|---|---|---|---|
| 3,823,332 | 7/1974 | Feryska et al. . | |
| 4,994,730 | 2/1991 | Rossi et al. | 323/316 |
| 5,289,425 | 2/1994 | Horiguchi et al. | 365/226 |
| 5,300,813 | 4/1994 | Ihara | 323/315 |
| 5,426,616 | 6/1995 | Kajigaya et al. | 365/226 |
| 5,448,190 | 9/1995 | Etoh | 327/103 |
| 5,463,339 | 10/1995 | Riggio, Jr. | 327/206 |
| 5,467,052 | 11/1995 | Tsukada | 327/543 |
| 5,493,205 | 2/1996 | Gorecki | 323/315 |
| 5,514,948 | 5/1996 | OKazaki | 323/314 |
| 5,545,970 | 8/1996 | Parkes, Jr. et al. | 323/277 |
| 5,568,084 | 10/1996 | McClure et al. | 327/538 |
| 5,585,765 | 12/1996 | O'Shaughnessy | 331/111 |
| 5,594,382 | 1/1997 | Kato et al. | 327/539 |
| 5,672,960 | 9/1997 | Manaresi et al. | 323/313 |

FOREIGN PATENT DOCUMENTS

| | | | |
|---|---|---|---|
| A-0 397 408 | 11/1990 | European Pat. Off. | G05F 3/24 |
| A-2 071 955 | 9/1981 | United Kingdom . | |

OTHER PUBLICATIONS

IEEE Journal Of Solid–State Circuits, vol. 27, No. 9, Sep. 1992, pp. 1277–1285, Zhenhua Wang "Automatic Vt Extractors, based on a . . . and their Application".

IEE Proceedings G Electronic Circuits & Systems, vol. 3, No. 1, 1979 Stevenage GB, pp. 1–4, Y:P: Tsividis, et al. "Threshold Voltage Generation and Supply Independent Biasing In C.M.O.S. Integrated Circuits".

*Primary Examiner*—Terry D. Cunningham

*Attorney, Agent, or Firm*—Wolf, Greenfield & Sacks, P.C.

[57] ABSTRACT

A transistor threshold extraction circuit having an output and including a first and a second transistor of the same type each having a control terminal and having essentially the same threshold voltage, the control terminal of the first transistor being connected to a constant potential node, a current mirror having at least one input terminal and one output terminal coupled respectively to said first and second transistors to provide bias currents, a first and a second potential reference, and a voltage divider having an intermediate tap and first and second end terminals. The control terminal of the second transistor is coupled to the intermediate tap and the divider is biased by coupling the first and the second end terminals respectively to the first and second potential references. The output is coupled to one of said end terminals.

25 Claims, 2 Drawing Sheets

THRESHOLD EXTRACTING METHOD AND CIRCUIT USING THE SAME

BACKGROUND OF THE INVENTION

1. Field of the Invention

The present invention relates to a transistor threshold extraction method and to a transistor threshold extraction circuit.

2. Background of the Invention

Threshold extraction finds various applications in the field of the characterization of electronic devices, level translation, absolute or relative temperature measurement, temperature compensation, and compensation of process parameters. A specific panorama of this subject is set forth in the article by Zhenhua Wang, "Automatic Vt Extractors . . . and Their Applications", in IEEE Journal of Solid-State Circuits, Vol. 27 No. 9 pages 1277–1285, September 1992.

This article discloses the circuit shown in FIG. 1. The circuit of FIG. 1 comprises two n-channel MOS transistors M1 and M2 having the same threshold voltage and a current mirror MC having an input terminal IM and an output terminal OM. It has an input IT and an output OT. The source terminals S1 and S2 of the transistors M1 and M2 are connected to a ground terminal GND, their drain terminals D1 and D2 are respectively connected to ethe terminals IM and OM, and their gate terminals G1 and G2 are respectively connected to the input IT and output OT. In addition the gate and drain terminals of the transistor M2 are connected together.

The potential at the output OT is given by a linear combination of the input potential IT and the threshold voltage of the transistors M1 and M2. This depends only on geometric parameters with the exception however of the potential at the input IT.

The Wang article discussed above proposes a variation of the circuit of FIG. 1 by selecting the W:L, ratio of transistor M1 equal to one fourth of W:L ratio of the transistor M2 and connecting to the output of the FIG. 1 circuit an amplifier with a gain of two, to provide at the output a potential equal to the sum of the potential at the input IT and the threshold voltage of the transistors M1 and M2.

The circuits described above have an advantage of extracting the threshold voltage of the transistors free from body effect since the source terminals of the n-channel transistors are connected to the substrate (in the case of N-well process) or to the process well (in the case of P-well process). Other circuits require separate wells in which to insert the transistors to be free of the body effect, or have a limitation that the threshold extraction is limited to transistors of a single polarity.

The purpose of the present invention is to supply an alternative circuit to that of the prior art.

SUMMARY OF THE INVENTION

In embodiments of the present invention a voltage divider and an appropriate bias network for feedback of a transistor are connected to an extractor circuit output to achieve the same advantages as the circuits of the prior art but with greater simplicity and effectiveness.

In addition, embodiments of the present invention reduce the contribution of the potential at the input of the circuit on the extracted threshold.

In one embodiment of the present invention, several extractor circuits in accordance with the prior art using transistors all having essentially the same threshold are connected in cascade.

In another embodiment, a predetermined potential is supplied at the input of an extractor circuit and said predetermined potential is subtracted from the output to determine a threshold voltage.

The present invention also relates to a circuitry system using and comprising a circuit in accordance with the present invention for operating independently of temperature and/or dispersion of process parameters.

DETAILED DESCRIPTION

Figure 2:
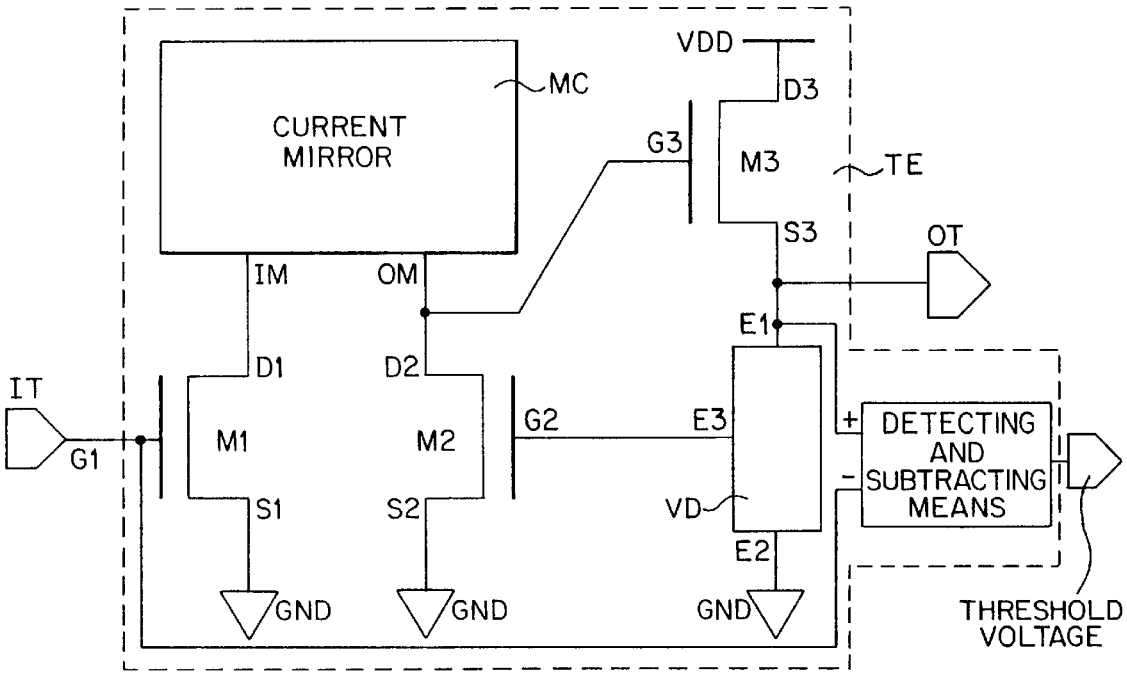
FIG. 2 shows a first circuit in accordance with one embodiment of the present invention.

The circuit of FIG. 2 comprises two n-channel MOS transistors M1 and M2 having essentially the same threshold voltage and a current mirror MC having an input terminal IM and an output terminal OM. It has an input IT and an output OT. The source terminals S1 and S2 of the transistors M1 and M2 are connected to a ground terminal GND while their drain terminals D1 and D2 are connected respectively to the terminals IM and OM, and a gate terminal GI of transistor M1 is connected to the input IT. The circuit also comprises a transistor M3 having its drain terminal D3 connected to a power supply terminal VDD, a gate terminal G3 connected to the terminal D2 and a source terminal S3 connected to the output OT. The circuit further comprises a voltage divider VD having an intermediate tap E3 and two end terminals E1 and E2. The tap E3 is connected to a gate terminal G2 of transistor M2, the first terminal E1 is connected to the output OT, and the second terminal E2 is connected to a ground terminal GND. As may be seen, the output section of the circuit comprises a feedback loop.

The terminals VDD and GND could be replaced by two generic potential references without changing essentially the operation of the circuit.

The divider VD is generally provided by means of a pair of two-terminal elements connected in series. It is also possible to not connect the tap E3 directly to the terminal G2 but to place between them a third two-terminal element, analogous to the first two. The three two-terminal elements may consist of resistors whose reciprocal value can be well-controlled during production. Alternatively, at least the pair of two terminal elements connected in series can be provided by means of two diode-connected MOS transistors or in many other known ways.

In the general case of using three two-terminal elements, e.g., three resistors, their value should be chosen on the basis of the requirements of the system in which the circuit is to be inserted. It is not excluded that the value of one of them could be null.

The potential at the output OT is given by a linear combination of the potential at the input IT and the threshold voltage of the transistors M1 and M2. This depends only on geometric parameters of the transistors and the potential at the input IT.

The simplest case and hence the most advantageous is to use as divider VD a divider by two and consequently a mirror MC having current gain between input and output selected or adjusted by a known technique to be equal to four, i.c., the square of the reciprocal of the division ratio (naturally the true values depend on the manufacturing tolerances). In this manner the potential at the output OT is given by the sum of the potential at the input IT and the threshold voltage.

In the circuit of FIG. 2 the transistors are operated in saturation conditions to take advantage of the fact that in this manner the current in the transistors does not depend (in a first approximation) on the voltage VDS, the voltage from the drain to the source of the transistors.

The operating principle of the output part of the circuit is as follows. The potentials of the circuit are stabilized at a value such that there are no currents flowing in the gate terminals of the transistors M2 and M3. Since the current flowing in the transistor M3 and in the divider VD is free to take any value, it stabilizes at a value such as to hold in balance said divider. If the divider is made up of two equal two terminal elements, the potential at the output OT corresponds to twice the potential at the terminal G2.

Figure 3:
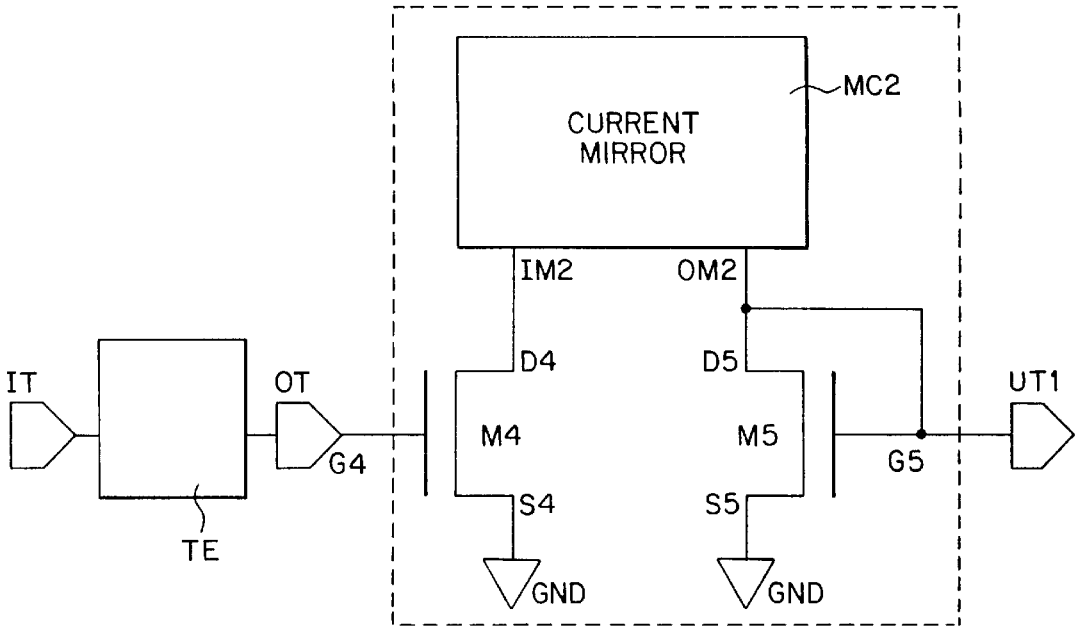
FIG. 3 shows a second circuit in accordance with another embodiment of the present invention.

A second circuit in accordance with the present invention is shown in FIG. 3. It consists of a threshold extractor circuit TE like the one just described and also, for example, the circuit of the prior art shown in FIG. 1, and of a stage having one input connected to the output OT and having an output of its own UT1. This stage is identical to the extractor circuit of the prior art shown in FIG. 1.

It comprises two n-channel MOS transistors M4 and M5 having the same threshold voltage as that of the transistors M1 and M2 and another current mirror MC2 having an input terminal IM2 and an output terminal OM2. It has an input connected to the output OT and an output of its own UT1. The source terminals S4 and S5 of the transistors M4 and M5 are connected to the ground terminal GND, their drain terminals D4 and D5 are respectively connected to the terminals IM2 and OM2, their gate terminals G4 and G5 are respectively connected to the input OT and the output UT1. In addition the gate and drain terminals of the transistor M5 are connected together.

If the circuit of FIG. 2 is used as the extractor circuit with a division ratio of 1:2 and current gain of the mirror MC selected or adjusted by a known technique to be equal to 4 and choosing, e.g., the gain of the mirror MC2 approximately unitary and indicating by K4, K5 the W:L ratio respectively of M4, M5, the potential at the output UT1 is given by the sum of the threshold voltage (only one for the, four transistors) and the potential of the terminal IT multiplied by a constant having the value:

$$\sqrt{\frac{K4}{K5}}$$

This new constant depends only on geometric parameters and can thus be controlled and made either much greater or much smaller than the old constant depending on requirements.

Naturally one or more of such stages could be connected in cascade depending on the value of the desired constant.

Figure 4:
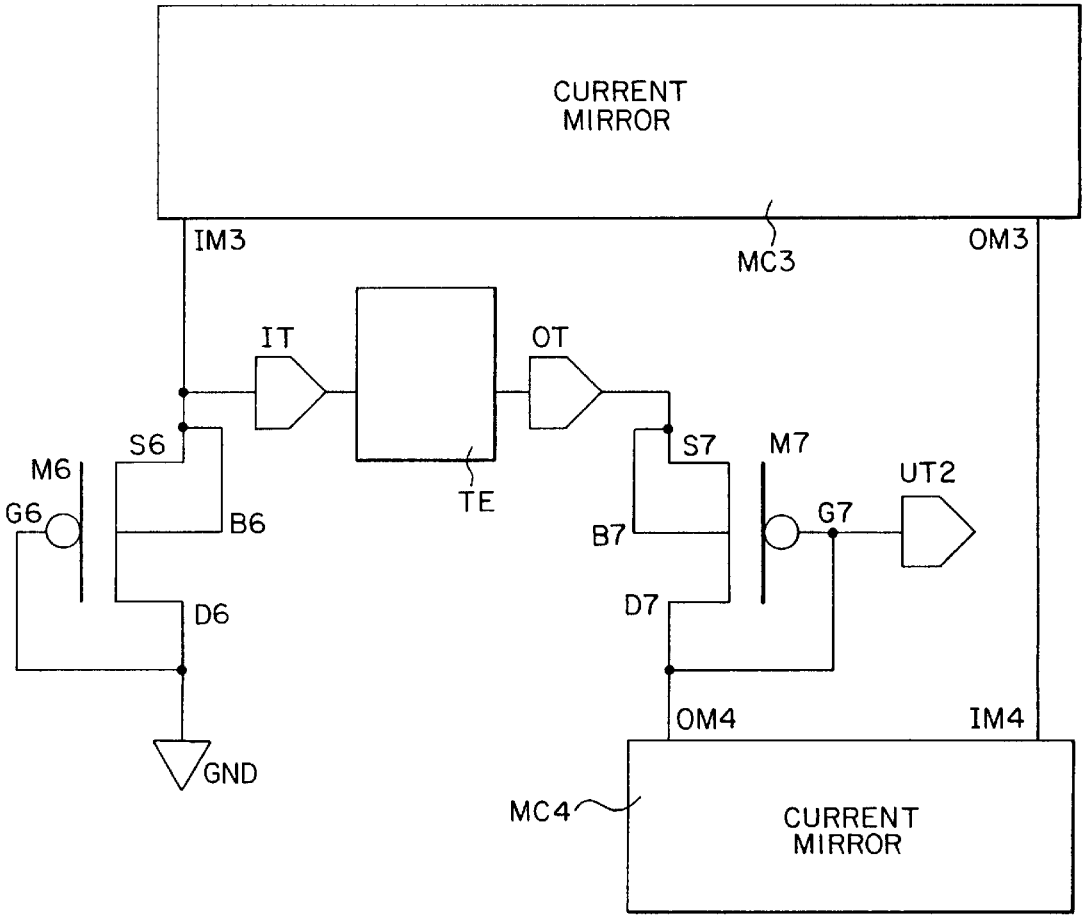
FIG. 4 shows a third circuit in accordance with another embodiment of the present invention.

A third circuit in accordance with the present invention is shown in FIG. 4 and has an output UT2. This is based on a threshold extractor circuit TE like the one described above, or even like the one of the prior art shown in FIG. 1, which supplies to the output OT a potential corresponding to the sum of the threshold and the potential at the input IT.

The circuit of FIG. 4 also comprises two essentially identical two-terminal elements and a bias network connected to the two terminal elements to supply to them an essentially identical bias current.

In the embodiment of FIG. 4 the two two-terminal elements correspond to two essentially identical p-channel MOS transistors M6 and M7. The transistor M6 has a gate terminal G6 and a drain terminal D6 connected together to ground and has a source terminal S6 and a bulk terminal B6 connected together at the input IT. The transistor M7 has a gate terminal G7 and a drain terminal D7 connected together at the output UT2 and has a source terminal S7 and a bulk terminal B7 connected together at the output OT.

The source and bulk terminals of the two transistors M6 and M7 are connected together to avoid body effect on a voltage from the drain to the source. This connection requires two separate wells for the transistors.

The bias network comprises two current mirrors MC3 and MC4 having input terminals IM3 and IM4 and output terminals OM3 and OM4 respectively.

The input terminal IM3 is connected to the source terminal S6 of transistor M6 to supply the source terminal with bias current. The terminal OM3 is connected to the terminal IM4. The terminal OM4 is connected to the transistor M7 and to the terminal D7 to supply terminal D7 with the bias current. The current through transistor M6 must therefore be equal to the current through transistor M7, if the current gain in both mirrors MC3 and MC4 is unitary.

For correct operation of this circuit, it is important that the potential at the output OT of the circuit TE not be influenced by the supplied current. In other words, the output resistance of the circuit TE must be quite low.

The two two-terminal elements can also be provided by means of two resistors, the resistance values of these resistors being equal or having a ratio, such that the voltage drop across the resistors at steady state is equal. More generally, the circuit TE is a circuit supplying at the output a linear combination of the potential at the input and a threshold voltage of transistors in the circuit TE, then the voltage across the two resistors should not be equal but in a ratio corresponding to the coefficient of the linear combination. Two variables influence the voltage across the two resistors, namely the value of the resistors and the currents supplied to them by the mirrors.

In the foregoing description, reference is made to direct connections between the various circuit elements, however, it should be clear to those skilled in the art that indirect connections, i.e. with other, intermediate, circuit elements, which can also be referred to as "couplings", could be used without impairing the operation of the associated circuits.

The above described circuits serve to extract the threshold of n-channel MOS transistors. To extract the threshold of p-channel transistors it would be necessary to use dual circuits. Some examples of said duality are that the ground terminals GND must be replaced by power supply terminals VDD, the power supply terminals VDD by ground terminals GND, the n-channel transistors by p-channel transistors, the p-channel transistors by n-channel transistors, etc.

It is also possible to use, instead of MOS transistors, other types of transistors, e.g., Bipolar Junction Transistors (BJTs). In this case however the threshold concept is less accurate and could correspond to a voltage established between a base and an emitter of a BJT.

Figure 1:
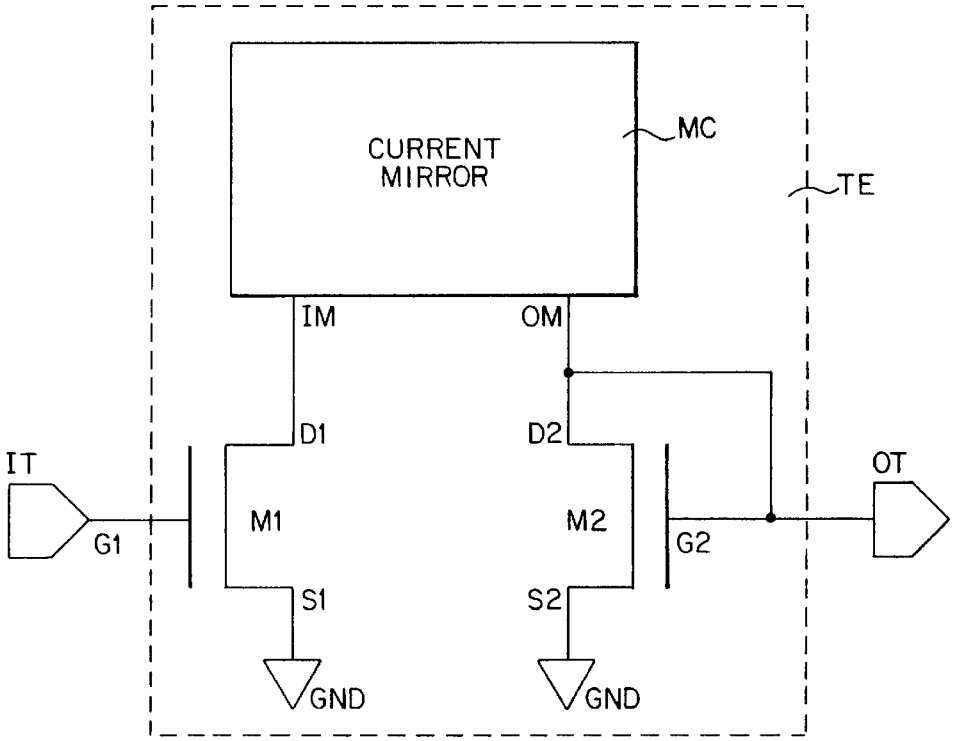
FIG. 1 (PRIOR ART)
FIG. 1 shows a circuit in accordance with the prior art.

Embodiments of the present invention also include a method of using a circuit of the type shown in FIG. 1 and in the use of a voltage divider and an appropriate bias network to provide feedback to the transistor connected to the output of said circuit.

The simplest case and hence the most advantageous is to use a divider by two and consequently a mirror having current gain between input and output equal to four. Naturally the exact values of the divider and the current gain depend on the manufacturing tolerances.

In accordance with another aspect of the present invention the contribution of the constant potential to the input of the extractor circuit is reduced by subtracting in accordance with any of a variety of known techniques, said constant potential at the output, totally or partially.

Lastly, as mentioned above, the present invention finds advantageous application in a system that operates independently of temperature and/or dispersion of process parameters.

Such a system includes an operating circuit block, at least one threshold extraction circuit in accordance with one of the embodiments described above and having an output, and at least one bias network having an input coupled to said output of the threshold extraction circuit and having an output coupled to said operating circuit block to supply bias currents and/or voltages.

The purpose of such a bias network is to generate a bias current or voltage linked to the threshold of a reference element. Assuming that the threshold has a value which depends on a physical parameter and assuming that block operation of the circuit block has an analogous dependence on the same parameter, by acting on the bias currents and/or voltages applied to the operating circuit block in relation to the value of said threshold it is possible to compensate for variations of the parameter (in time or from device to device) to achieve constant block operation.

These types of bias networks are well known in the literature and in any case within the capability of those skilled in the art. An example of a voltage supply circuit is found in the article of M. Sasaki and F. Ueno, "A Novel Implementation of Fuzzy Logic Controller Using New Meet Operation", in Proceedings of the THIRD IEEE INTERNATIONAL CONFERENCE ON FUZZY SYSTEMS, Vol. III, pages 1676–1681, 26–29 Jun. 1994.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalent thereto.

What is claimed is:

1. A method of determining a threshold voltage of a transistor using a current mirror circuit having at least one input terminal and one output terminal, at least one first transistor having a first ratio between its channel width and length and at least one second transistor having a second ratio between its channel width and length, each transistor being a field effect transistor and having substantially a same threshold voltage to be determined by the method, and each transistor having a control terminal, said current mirror circuit supplying first and second bias currents to said first and second transistors, respectively, through said input and output terminals, a third ratio between the first and second bias currents being selected to be different than a fourth ratio between the first ratio of the first transistor and the second ratio of the second transistor, the control terminal of said first transistor being coupled to a constant potential node, the method comprising steps of:

coupling a voltage divider having a division ratio to the control terminal of the second transistor; and biasing the voltage divider, based on an output value of the mirror circuit, such that a potential at a first terminal of the voltage divider is indicative of the threshold voltage of the transistors.

2. A method of determining a threshold voltage of a transistor using a current mirror circuit having at least one input terminal and one output terminal at least one first transistor having a first ratio between its channel width and length and at least one second transistor having a second ratio between its channel width and length, each transistor being a field effect transistor and having substantially a same threshold voltage to be determined by the method, and each transistor having a control terminal, said current mirror circuit supplying first and second bias currents to said first and second transistors, respectively, through said input and output terminals, a third ratio between the first and second bias currents being selected to be different than a fourth ratio between the first ratio of the first transistor and the second ratio of the second transistor, the control terminal of said first transistor being coupled to a constant potential node the method comprising steps of:

coupling a voltage divider having a division ratio to the control terminal of the second transistor;

biasing the voltage divider, based on an output value of the mirror circuit, such that a potential at a first terminal of the voltage divider is indicative of the threshold voltage of the transistors; and selecting a gain of the mirror circuit to be a square of the reciprocal of the division ratio of the voltage divider, wherein the gain of the mirror circuit is approximately four;

wherein the first and second transistors are substantially the same.

3. A method of determining a threshold voltage of a transistor using a current mirror circuit having at least one input terminal and one output terminal, at least one first transistor having a first ratio between its channel width and length and at least one second transistor having a second ratio between its channel width and length each transistor being a field effect transistor and having substantially a same threshold voltage to be determined by the method and each transistor having a control terminal, said current mirror circuit supplying first and second bias currents to said first and second transistors, respectively, through said input and output terminals, a third ratio between the first and second bias currents being selected to be different than a fourth ratio between the first ratio of the first transistor and the second ratio of the second transistor, the control terminal of said first transistor being coupled to a constant potential node, the method comprising steps of:

coupling a voltage divider having a division ratio to the control terminal of the second transistor;

biasing the voltage divider, based on an output value of the mirror circuit, such that a potential at a first terminal of the voltage divider is indicative of the threshold voltage of the transistors;

detecting the potential at the first terminal of the voltage divider; and subtracting a voltage level of the constant potential node from the potential at the first terminal of the voltage divider to determine the threshold voltage of the first and second transistors.

4. A transistor threshold voltage extraction circuit having a first output comprising:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit; and a voltage divider having an intermediate tap and first and second end terminals and having a voltage division ratio;

wherein the control terminal of said second transistor is coupled to said intermediate tap and said voltage divider is biased based on an output value at the output terminal of the first current mirror circuit, and wherein the first output of the voltage threshold extraction circuit is coupled to said first end terminal, and said first output provides an output potential indicative of the threshold voltage of the first and second transistors.

5. A transistor threshold voltage extraction circuit having a first output comprising:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node, a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor, a high impedance buffer having a first terminal coupled to the output terminal of the first current mirror circuit, having a second terminal coupled to a first potential reference, and having a third terminal coupled to the first output of the transistor threshold voltage extraction circuit; and a voltage divider having an intermediate tap and first and second end terminals and having a voltage division ratio;

wherein the control terminal of said second transistor is coupled to said intermediate tap and said voltage divider is biased based on an output value at the output terminal of the first current mirror circuit, and wherein the first output of the voltage threshold extraction circuit is coupled to said first end terminal, and said first output provides an output potential indicative of the threshold voltage of the first and second transistors, wherein the first and second transistors are substantially the same and wherein said first current mirror circuit has a selected current gain substantially equal to a square of the reciprocal of the voltage division ratio, and wherein the current gain is approximately four.

6. The transistor threshold voltage extraction circuit of claim 4, wherein the high impedance buffer comprises a third transistor having a control terminal coupled to said output terminal of the mirror circuit, a first main conduction terminal coupled to the first potential reference and a second main conduction terminal coupled to said first end terminal.

7. The transistor threshold voltage extraction circuit of claim 4, wherein the first and second transistors are MOS transistors constructed and arranged to operate in a saturation condition.

8. The transistor threshold voltage extraction circuit of claim 4, wherein said voltage divider includes at least two resistors.

9. A transistor threshold voltage extraction circuit having a first output comprising:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit;

a voltage divider having an intermediate tap and first and second end terminals and having a voltage division ratio;

first and second two terminal elements; and a bias network having at least one output, the bias network being coupled to said two terminal elements to supply a substantially identical bias current to each of the two terminal elements;

wherein one terminal of said first two terminal element corresponds to said constant potential node and wherein said second two terminal element is coupled between said at least one output of the bias network and one of said end terminals, and wherein the control terminal of said second transistor is coupled to said intermediate tap and said voltage divider is biased based on an output value at the output terminal of the first current mirror circuit, and wherein the first output of the voltage threshold extraction circuit is coupled to said first end terminal, and said first output provides an output potential indicative of the threshold voltage of the first and second transistors.

10. A transistor threshold voltage extraction circuit having a first output and a second output comprising:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit;

a voltage divider having an intermediate tap and first and second end terminals and having a voltage division ratio;

a third transistor having a fifth ratio between its channel width and length and a fourth transistor having a sixth ratio between its channel width and length each being a field effect transistor having a control terminal, and having a threshold voltage substantially equal to the threshold voltage of said first and second transistors, the control terminal of said third transistor being coupled to said first end terminal; and a second current mirror circuit having at least one input terminal and one output terminal coupled respectively to first terminals of said third and fourth transistors to respectively supply third and fourth bias currents, a seventh ratio between the third and fourth bias currents being selected to be different than an eighth ratio between the fifth ratio of the third transistor and the sixth ratio of the fourth transistor;

wherein said second output of the threshold voltage extraction circuit is coupled to the control terminal of said fourth transistor and the output terminal of said second current mirror circuit, and wherein a second terminal of each of the third and fourth transistors is coupled to a common reference potential; and wherein the control terminal of said second transistor is coupled to said intermediate tap and said voltage divider is biased based on an output value at the output terminal of the first current mirror circuit, and wherein the first output of the voltage threshold extraction circuit is coupled to said first end terminal, and said first output provides an output potential indicative of the threshold voltage of the first and second transistors.

11. A circuit comprising:

an operating circuit block, a threshold voltage extraction circuit having a first output including:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit; and a voltage divider having an intermediate tap and first and second end terminals and having a voltage division ratio; and wherein the control terminal of said second transistor is coupled to said intermediate tap and said voltage divider is biased based on an output value at the output of the first current mirror circuit, and wherein the first output of the voltage threshold extraction circuit is coupled to said first end terminal, and said first output provides an output potential indicative of the threshold voltage of the first and second transistors; and at least one bias network having an input coupled to said first output of the threshold voltage extraction circuit and having an output coupled to said operating circuit block to bias said operating circuit block.

12. A circuit comprising:

an operating circuit block, a threshold voltage extraction circuit having a first output including:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit; and a voltage divider having an intermediate tap and first and second end terminals and having a voltage division ratio; and wherein the control terminal of said second transistor is coupled to said intermediate tap and said voltage divider is biased based on an output value at the output of the first current mirror circuit, and wherein the first output of the voltage threshold extraction circuit is coupled to said first end terminal, and said first output provides an output potential indicative of the threshold voltage of the first and second transistors; and at least one bias network having an input coupled to said first output of the threshold voltage extraction circuit and having an output coupled to said operating circuit block to bias said operating circuit block;

wherein the first and second transistors of the threshold voltage extraction circuit are substantially the same and wherein said first mirror circuit has a selected current gain substantially equal to a square of the reciprocal of the division ratio of said voltage divider.

13. The circuit of claim 12, wherein the current gain of the mirror circuit is selected to be approximately four.

14. The circuit of claim 11, wherein the high impedance buffer comprises a third transistor having a control terminal coupled to said output terminal of the first mirror circuit and a first main conduction terminal coupled to a first potential reference and a second main conduction terminal coupled to said first end terminal.

15. A circuit comprising:

an operating circuit block, a threshold voltage extraction circuit having a first output including:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit;

a voltage divider having an intermediate tap and first and second end terminals and having a voltage division ratio;

first and second two terminal elements, each having first and second end terminals, the first end terminal of the first two terminal element being coupled to the control terminal of the first transistor, the first end terminal of the second two terminal element being coupled to the first end terminal of the voltage divider, and the second end terminal of the first two terminal element being coupled to a second potential reference;

at least one bias network having an input coupled to said first output of the threshold voltage extraction circuit and having an output coupled to said operating circuit block to bias said operating circuit block;

wherein the control terminal of said second transistor is coupled to said intermediate tap and said voltage divider is biased based on an output value at the output of the first current mirror circuit, and wherein the first output of the voltage threshold extraction circuit is coupled to said first end terminal, and said first output provides an output potential indicative of the threshold voltage of the first and second transistors; and wherein the bias network is coupled to said first terminal of the first two terminal element and said second terminal of said second terminal element to supply a substantially identical bias current to each of the two terminal elements.

16. A circuit comprising:

an operating circuit block, a threshold voltage extraction circuit having a first output and a second output including:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit;

a voltage divider having an intermediate tap and first and second end terminals and having a voltage division ratio;

a third transistor having a fifth ratio between its channel width and length and a fourth transistor having a sixth ratio between its channel width and length, each having a control terminal and having a threshold voltage substantially equal to the threshold voltage of said first and second transistors, the control terminal of said third transistor being coupled to one of said end terminals, and a second current mirror circuit having at least one input terminal and one output terminal coupled respectively to first terminals of said third and fourth transistors to respectively supply third and fourth bias currents, a seventh ratio between the third and fourth bias currents being selected to be different than an eighth ratio between the fifth ratio of the third transistor and the sixth ratio of the fourth transistor; and at least one bias network having an input coupled to said first output of the threshold voltage extraction circuit and having an output coupled to said operating circuit block to bias said operating circuit block;

wherein the control terminal of said second transistor is coupled to said intermediate tap and said voltage divider is biased based on an output value at the output of the first current mirror circuit, and wherein the first output of the voltage threshold extraction circuit is coupled to said first end terminal, and said first output provides an output potential indicative of the threshold voltage of the first and second transistors; and wherein said second output of the threshold voltage extraction circuit is coupled to the control terminal of said fourth transistor and the output terminal of said second current mirror circuit, and wherein a second terminal of each of the third and fourth transistors is coupled to a common reference potential.

17. A threshold voltage extraction circuit for determining a threshold voltage of a transistor comprising:

a current mirror circuit having a selected gain and having at least one input terminal and one output terminal;

a first transistor having a first ratio between its channel width and length and a second transistor having a second ratio between its channel width and length, each transistor being a field effect transistor and having substantially a same threshold voltage, and each transistor having a control terminal, a first terminal, and a second terminal, said first terminals of said first and second transistors being respectively coupled to said input and output terminals of the current mirror circuit to respectively receive first and second bias currents from the current mirror circuit, a third ratio between the first and second bias currents being selected to be different than a fourth ratio between the first ratio of the first transistor and the second ratio of the second transistor, the control terminal of said first transistor being coupled to a constant potential node;

a voltage divider having first and second terminals an intermediate tap, and a division ratio, wherein the intermediate tap is coupled to the control terminal of the second transistor; and a bias circuit that biases the voltage divider such that a potential at the first terminal of the voltage divider is indicative of the threshold voltage of the first and second transistors, wherein the bias circuit has a first terminal coupled to the output terminal of the current mirror circuit and a second terminal coupled to the first terminal of the voltage divider, and wherein the second terminals of the first and second transistors and the voltage divider are coupled to a common reference potential.

18. The threshold voltage extraction circuit of claim 17, wherein the first and second transistors are substantially the same, and the selected gain of the mirror circuit is substantially equal to a square of the reciprocal of the division ratio of the voltage divider.

19. A circuit comprising:

a first threshold voltage extraction circuit having an input and output; and a second threshold voltage extraction circuit having an input coupled to the output of the first threshold voltage extraction circuit and having an output;

wherein one of the first and second threshold voltage extraction circuits includes:

a current mirror circuit having a selected gain and having at least one input terminal and one output terminal;

a first transistor having a first ratio between its channel width and length and a second transistor having a second ratio between its channel width and length, each transistor being a field effect transistor and having substantially a same threshold voltage, and each transistor having a control terminal, said first and second transistors being respectively coupled to said input and output terminals of the current mirror circuit to respectively receive first and second bias currents from the current mirror circuit, a third ratio between the first and second bias currents being selected to be different than a fourth ratio between the first ratio of the first transistor and the second ratio of the second transistor, the control terminal of said first transistor being coupled to a constant potential node;

a voltage divider having a division ratio coupled to the control terminal of the second transistor; and means for biasing the voltage divider, based on an output value at the output terminal of the current mirror circuit such that a potential at a first terminal of the voltage divider is indicative of the threshold voltage of the first and second transistors.

20. A circuit comprising:

a first current mirror circuit having an input and an output;

a second current mirror circuit having an input coupled to the output of the first mirror circuit and having an output;

a first two-terminal device coupled between the input of the first current mirror circuit and a first voltage reference;

a threshold voltage extraction circuit having an input coupled to the input of the first current mirror circuit and having an output;

a second two-terminal device coupled between the output of the threshold voltage extraction circuit and the output of the second current mirror circuit; and an output coupled to the output of the second current mirror circuit.

21. The circuit of claim 20, wherein the threshold voltage extraction circuit includes:

a current mirror circuit having a gain and having at least one input terminal and one output terminal;

first and second transistors, each transistor having substantially a same threshold voltage, and each transistor having a control terminal, said first and second transistors being respectively coupled to said input and output terminals of the current mirror circuit to receive bias currents from the current mirror circuit, the control terminal of said first transistor being coupled to a constant potential node;

a voltage divider having a division ratio coupled to the control terminal of the second transistor; and a bias circuit that biases the voltage divider such that a potential at a first terminal of the voltage divider is indicative of the threshold voltage of the first and second transistors.

22. The method of claim 1, further comprising a step of coupling a terminal of each of the first and the second transistors and a terminal of the voltage divider to a common reference potential.

23. The transistor threshold voltage extraction circuit of claim 4, wherein a terminal of each of the first and second transistors and the second end terminal of the voltage divider are coupled to a common reference potential.

24. A method of determining a threshold voltage of a transistor using a current mirror circuit having at least one input terminal and one output terminal, at least one first transistor having a first ratio between its channel width and length and at least one second transistor having a second ratio between its channel width and length, each transistor being a field effect transistor and having substantially a same threshold voltage to be determined by the method, and each transistor having a control terminal, said current mirror circuit supplying first and second bias currents to said first and second transistors, respectively, through said input and output terminals, a third ratio between the first and second bias currents being selected to be different than a fourth ratio between the first ratio of the first transistor and the second ratio of the second transistor, the control terminal of said first transistor being coupled to a constant potential node, the method comprising steps of:

coupling a voltage divider having a division ratio to the control terminal of the second transistor;

biasing the voltage divider, based on an output value of the mirror circuit, such that a potential at a first terminal of the voltage divider is indicative of the threshold voltage of the transistors; and selecting a gain of the mirror circuit to be a square of the reciprocal of the division ratio of the voltage divider;

wherein the first and second transistors are substantially the same.

25. A transistor threshold voltage extraction circuit having a first output comprising:

a first transistor having a first ratio between its channel width and length and a second transistor having a second ratio between its channel width and length, each being a field effect transistor and having a control terminal and having substantially the same threshold voltage, the control terminal of said first transistor being coupled to a constant potential node;

a first current mirror circuit having at least one input terminal and one output terminal coupled respectively to said first and second transistors to respectively supply first and second bias currents, a third ratio between the first and second bias currents being selected to be different than a fourth ratio between the first ratio of the first transistor and the second ratio of the second transistor;

a high impedance buffer having a first terminal coupled to the output terminal of the first current mirror circuit, having a second terminal coupled to a first potential reference, and having a third terminal coupled to the first output of the transistor threshold voltage extraction circuit; and a voltage divider having an intermediate tap and first and second end terminals and having a voltage division ratio;

wherein the control terminal of said second transistor is coupled to said intermediate tap and said voltage divider is biased based on an output value at the output terminal of the first current mirror circuit, and wherein the first output of the voltage threshold extraction circuit is coupled to said first end terminal, and said first output provides an output potential indicative of the threshold voltage of the first and second transistors, and further wherein the first and second transistors are substantially the same and wherein said first current mirror circuit has a selected current gain substantially equal to a square of the reciprocal of the voltage division ratio.

* * * * *